United States Patent [19]

Campbell

[11] 4,043,394

[45] Aug. 23, 1977

[54] PLUGGING OF ABANDONED DRY WELLS

[76] Inventor: Douglas C. Campbell, 30 Sandpiper Drive, Sherwood Park, Alberta, Canada

[21] Appl. No.: 692,189

[22] Filed: June 2, 1976

[30] Foreign Application Priority Data

June 9, 1975 Canada ..... 228868

[51] Int. Cl.[2] ..... E21B 33/13; E21B 47/04

[52] U.S. Cl. ..... 166/253; 166/290

[58] Field of Search ..... 166/253, 250, 289, 285, 166/290, 291

[56] References Cited

U.S. PATENT DOCUMENTS

| | | | |
|---|---|---|---|
| 2,171,840 | 9/1939 | Armentrout et al. | 166/253 |
| 2,217,708 | 10/1940 | Scaramucci | 166/253 |
| 2,220,205 | 11/1940 | Buckley | 166/253 |
| 2,308,176 | 1/1943 | Howell | 166/253 |
| 2,320,892 | 6/1943 | Scherbatskoy et al. | 166/253 |
| 2,398,324 | 4/1946 | Pontecorvo | 166/253 |
| 3,097,699 | 7/1963 | Orr | 166/289 X |
| 3,474,866 | 10/1969 | Dellinger et al. | 166/289 |
| 3,489,219 | 1/1970 | Higgins | 166/253 |

OTHER PUBLICATIONS

Howell et al., "Detection of Radioactive Cement in Cased Wells", AIMME, Tech. Pub. No. 1113, Galveston, Tex. Meeting, Oct. 1939, pp. 1-8.

*Primary Examiner*—Stephen J. Novosad

*Attorney, Agent, or Firm*—Stevens, Davis, Miller & Mosher

[57] ABSTRACT

In order to plug off potential producing zones in an abandoned well, cement is injected at the appropriate level in an amount estimated to be sufficient to seal off the zone. A selected portion of the cement, treated with a radioactive tracer, is injected to provide a layer of treated cement at the top of the wet cement plug and a probe or logging tool is thereafter used to locate the position of the top of the plug with the probe output being recorded graphically to provide a record of the position of the plug top.

4 Claims, 5 Drawing Figures

PLUGGING OF ABANDONED DRY WELLS

This invention relates generally to improvements in methods for plugging abandoned dry wells.

Various jurisdictions in the oil producing regions of certain countries require that plugs be inserted across potential producing zones on all dry wells. These potential producing zones were abandoned due to the fact that they were not commercially viable; however, for ecological and liability reasons, it is necessary that these zones be plugged to stop seepage, contamination, and communication between zones. The potential producing zones may produce oil, natural gas, various forms of other hydro-carbons, salt water and natural water. It will be appreciated that in any one well bore, the potential producing zones may be widely spaced apart; some may be producing a small amount of oil, others natural gas, while others are producing water, etc.

It will be appreciated that it would be most uneconomic to attempt to completely fill the well bore with cement. Therefore, it has become widely known to inject cement into the well in such a way that only the potential producing zones are blocked off. Ordinary drilling mud fills the well bore in the regions between the cement plugs. For the cement plugs to be effective, they must be properly located at the producing zones and must extend a certain minimum distance, say 50 feet, above and below the producing zone thereby to reduce the possibility of seepage.

A major problem in the past has been that of locating the cement plugs properly in relation to the producing zones. Of course, the elevations or locations of the various producing zones for each well are known. This information is derived from a so-called "open hole gamma-ray base log". This information is derived by lowering a gamma-ray tool or probe downwardly through the well bore to total depth or to the lowest depth desired to be logged or recorded and then slowly raising the tool or probe upwardly and plotting a graph or recording of the probe output as it slowly ascends. By examining the trace or graph, and in conjunction with other tools or probes run in the well bore, the nature, extent and elevations of the various formations throughout the length of the well bore can be determined.

One of the most generally accepted procedures for plugging abandoned dry wells is as follows:

1. Government approval to plug the abandoned well is obtained, including the specified intervals to plug off the potential producing zones.

2. The drill pipe is lowered downwardly into the well until its lower end is somewhat below the bottom of where the first cement plug is to be located. (The position of the lowermost producing zone is known from the above mentioned graphical information derived from the well logging operation).

3. The cement volume is calculated having regard to the interval or length of the cement plug to be placed across the zone or formation, the well bore diameter and the drill stem dimensions. The reason why the drill stem dimensions are of significance is that after the cement has been injected the drill stem or drill pipe must be lifted out of the cement and thus the level of the cement will drop by several feet depending on the displacement of the drill stem including the length of drill stem which is lifted out of the cement. Thus, this factor must be taken into account to ensure that the producing zone is properly plugged. In addition, an extra quantity of cement, nominally 20% above that calculated as described above, is included to provide a "safety factor".

4. Cement is then pumped down the drill pipe and exits through its lower end and then passes up the well bore to a point sufficiently high so that it will cover the zone required to be plugged as well as providing for an adequate degree of "safety factor" after the drill pipe has been lifted above the cement.

5. The drill pipe is then raised upwardly to a point above the top of the cement plug. Then, an eight hour waiting period is provided to allow the cement plug to harden sufficiently as to support at least a portion of the weight of the drill pipe. The drill pipe is then slowly lowered downwardly until it contacts the hardened cement. This procedure enables the plugging crew to determine by "feel" the exact position of the top of the cement plug. The elevation of the top of the plug is recorded and compared with the base log data to ensure that the cement plug is at the proper elevation. However, if an error has been made in calculating the volume of cement, or if some of the cement has spread into the producing zone, the plug may be too low, in which event, additional cement will have to be pumped into the drill hole and a further eight hour waiting period provided in order to allow the cement to harden and the location of the top of the plug located as described above.

6. Assuming the lowermost plug is found to be at the correct depth, the drill pipe is pulled up to a position adjacent the bottom of where the next plug is to be located and the procedure described above is repeated.

It will be appreciated that the well bore is filled from top to bottom with a fluid material commonly termed "drilling mud". Thus, the regions between the various plugs in the well bore will be filled with drilling mud.

In accordance with the present invention, a similar procedure is used for putting the cement plugs in place and lifting the drill pipe upwardly after this step has been taken. However, in accordance with the invention, the top portion of the cement plug is provided with a material which can be detected with a probe as, for example, a radioactive tracer material. Various types of radioactive tracer materials are commercially available.

The present invention provided a technique including treating certain portions of the cement which are injected into the well in such a fashion that the uppermost layer of the cement plug has the radiocative tracer material therein. (It would, of course, be unduly costly and completely impractical to attempt to treat the entire batch of cement making up the plug). Once the wet cement is put into position, the drill pipe is lifted above the plug and testing is commenced immediately to see whether the cement plug is properly located. This is easily done by using a conventional Gamma ray logging tool to detect the position of the top of the cement. By using this procedure, the eight hour waiting period required using prior art techniques is avoided thus saving a very considerable amount of time and expense. In addition, this new method gives a far more accurate reading of the location of the top of the cement plug, and the owner of the well, as well as the appropriate Government officials, can be provided with a log reading (or graphical reading) assuring them that all of the cement plugs are properly positioned in accordance with Government regulations.

Thus, one aspect of the invention provides, in a method of plugging a potential producing zone or formation of known extent and elevation in a well bore with cement, including the steps of positioning a hollow pipe or stem at a selected location relative to the lower level of the formation and injecting cement through said pipe in an amount estimated to be sufficient to extend at least the full length of said formation to prevent seepage from the formation after the pipe has been withdrawn and the cement has hardened, the improvement wherein a selected portion of the cement which is injected contains a radioactive tracer therein with said selected portion being injected such as to provide a layer of cement having said tracer therein at the top of the wet cement plug, and after the pipe has been withdrawn from the wet cement, lowering into the well bore a detecting means sensitive to and emitting an output in response to the presence of the tracer material, and determining the elevation of the top of the wet cement plug by analyzing the output of the detecting means.

A further aspect of the invention provides that in the event the level of the top of the plug is found to be too low, a further quantity of cement is added with a further selected portion of the cement being treated with said tracer such that a layer of cement having the tracer material therein is provided at the top of the newly added cement and the detecting means again lowered into the well bore whereby to determine the elevation of the top of the newly added cement.

In a still further aspect of the invention said cement which contains the radioactive tracer therein is injected in two parts, one part being injected first, with the untreated cement being injected thereafter and displacing the treated cement upwardly thereby to form a ring of treated cement around said pipe, and the other part of the treated cement being injected last so that it is located within said pipe at about the same level as said one part, the pipe being thereafter withdrawn from the cement thus allowing the two parts of treated cement to flow together to form said layer with one of said parts flowing over the other part if there is a difference in the levels of said two parts of treated cement at the end of the injection step.

The invention will be further described by way of example with reference to the attached drawings wherein.

Figure 1:
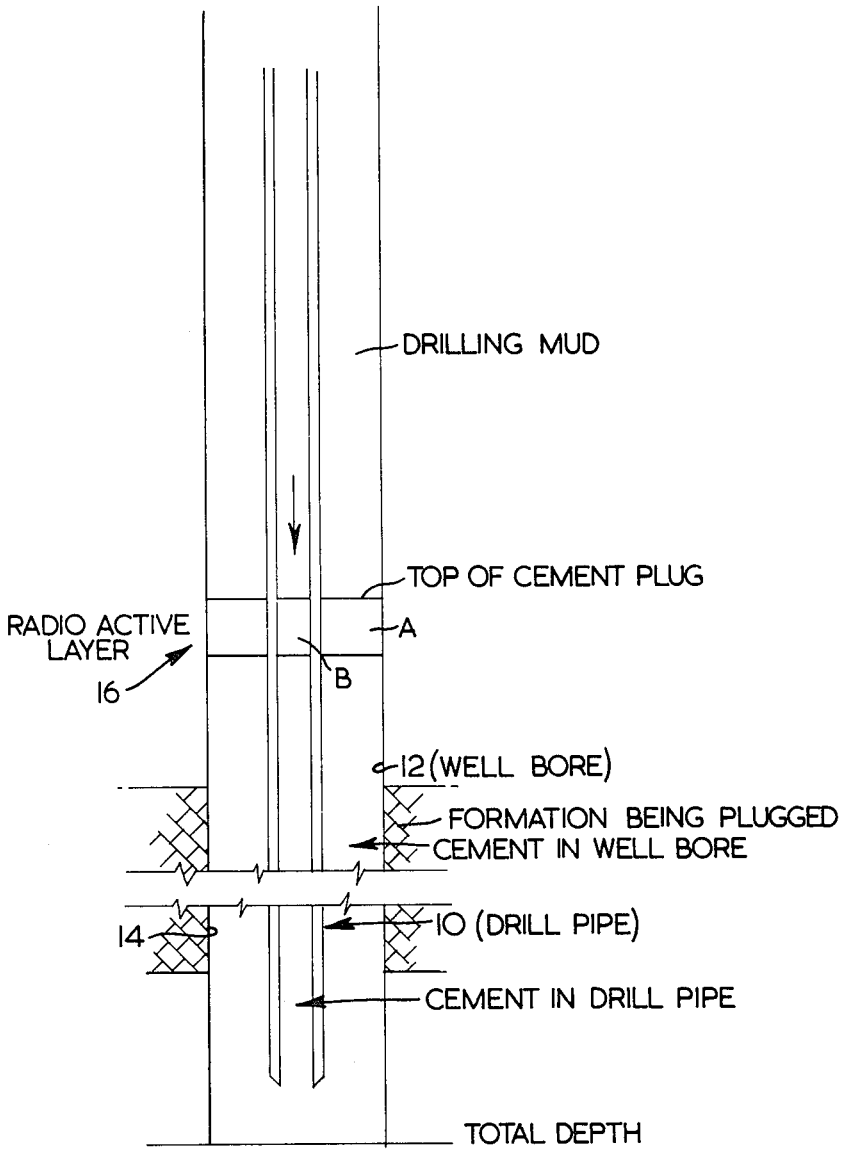
FIGS. 1 and 2 are diagrammatic views of a well bore illustrating the method of the invention.

With reference to FIG. 1 the drill pipe is located in the well bore with its lower end some 50 feet below the lower end of the formation or bearing zone which is to be plugged. The volume of cement required is calculated having regard to the length of the plug, well bore and drill stem dimensions and the desired "safety factor" as described above. However, in accordance with the invention, certain relatively small portions of the cement injected are treated with the radioactive isotope tracer so that the top portion of the cement plug which is ultimately formed contains a sufficient amount of radioactive material as to enable its detection by means of a conventional probe. This may be done, for example, by treating the first five sacks or so of cement with a radioactive isotope, then injecting untreated cement in the quantity required, and then treating the last five sacks or so of cement with the radioactive isotope. Assuming that the procedure has been carried out properly, a radioactive layer at the top of the plug appears as is shown in FIG. 1. Because of the fact that the first portion of the cement was treated with the isotope, the untreated cement subsequently injected displaces this initial layer of treated cement upwardly thereby to form a ring of treated cement surrounding the drill stem. This ring of treated cement is designated by the letter A. The treated last portion of cement injected remains within the drill pipe at approximately the same level as the ring A of cement and such portion is designated by reference B Many types of industrial tracers may be used in the concrete mix. It was mentioned above that in a typical operation five sacks, more or less, of cement treated with tracer were first injected, then the precalculated volume of cement, and, lastly, an additional five sacks, more or less, of cement were added including the tracer. By way of example, to make up the tracer-treated concrete mix, 10 sacks (one sack equals 80 pounds dry concrete or one cubic foot of concrete approximately) were treated with six ounces approximately of a radioactive sand tracer supplied by Gamma Industries, a division of Nuclear Systems, Inc. Catalogue No. 1051, designation RAST-192. This radioactive sand tracer uses an isotope consisting of iridium-192 having a half life of 74 days. The physical form of the tracer is iridium baked on sand.

The primary reason for treating both the first and last portions of cement injected is to avoid the possibility, in the event of some miscalculation which causes the first and last portions of cement injected to be at different levels, of an untreated layer of cement flowing over and covering up the treated radioactive layer thus making detection difficult. Thus, with the procedure described, in the event that cement ring A is somewhat higher than cement portion B, the cement ring A can flow inwardly and over cement portion B after the drill pipe has been lifted upwardly above the cement plug; however, since cement portion A has been treated with radioactive material, no problem arises. Likewise, if cement portion B is higher it flows outwardly over ring A until an equilibrium state is achieved.

After the radioactive layer has been established at the top of the wet cement plug the drill pipe is lifted upwardly. There will of course be a certain degree of settling of the concrete as the drill pipe is lifted upwardly, the amount of settling depending upon the plug length, well bore, drill stem dimensions etc. The drill pipe is lifted upwardly fairly slowly so as to avoid undue disturbance of the top radioactive layer and undue mixing of same with the lower untreated cement.

Figure 2:
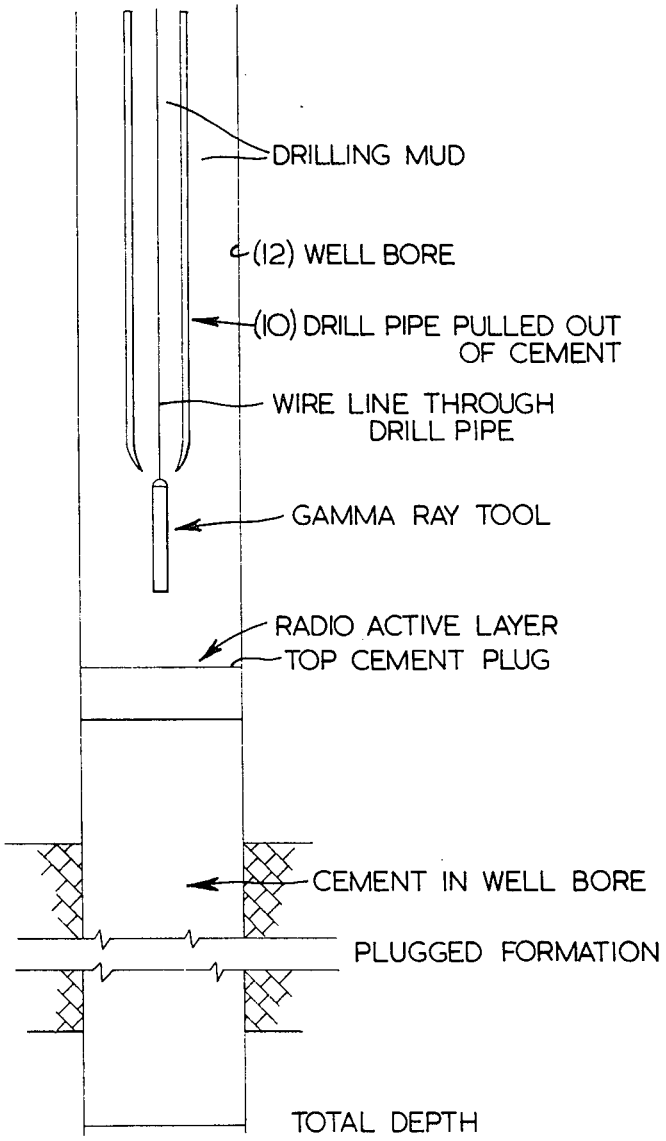
Figure 3:
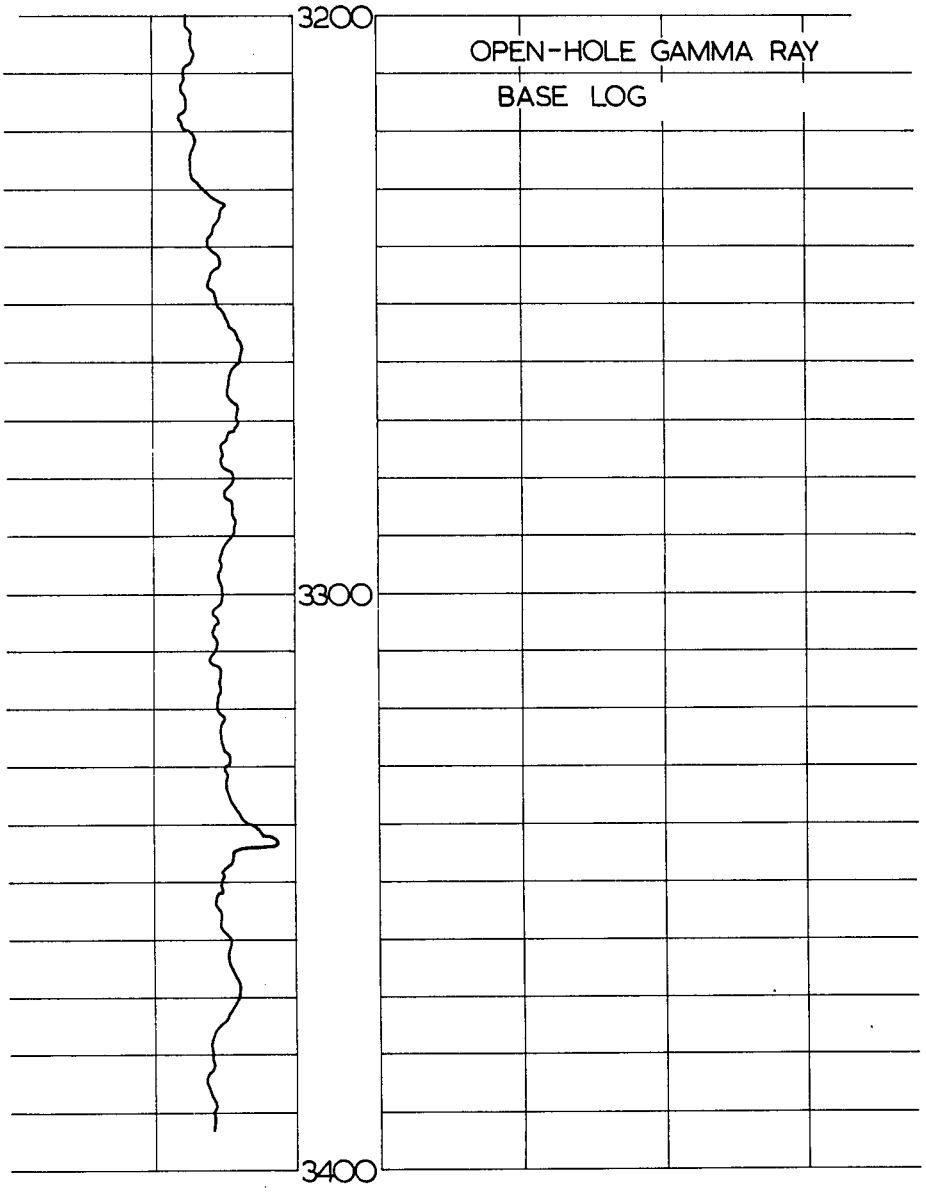
FIG. 3 illustrates a typical "open-hole" gamma ray base log or chart reading.
Figure 4:
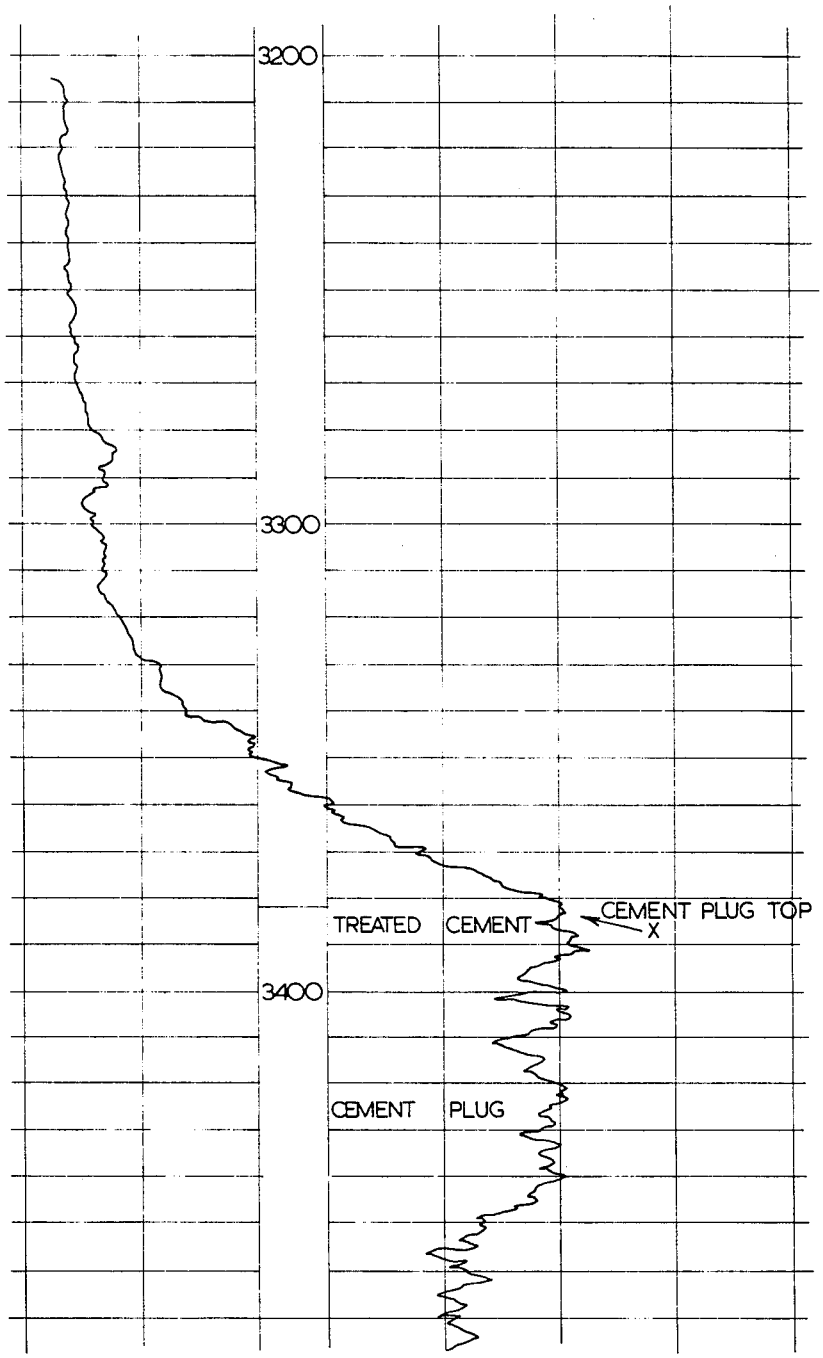
FIG. 4 is a typical probe output chart reading obtained in accordance with the practice of the invention.

With reference to FIG. 2, the next step is to lower the probe slowly downwardly through the drill pipe while observing the probe output as represented by the tracings provided by a stylus on a standard logging chart. As is well known in the art, the chart is moved in synchronism with the probe as it is lowered so that the tracings are correlated with the level of the probe in the well bore at all times. Since an open hole gamma-ray base log for the hole will have been taken during previous tests, the various deviations due to the formations at the various levels in the hole will be known and thus the operators will not be mislead by deviations resulting from these formations. By way of illustration, FIG. 3 gives a typical open hole gamma-ray base log reading between the 3200 and 3400 foot levels in a well. This may be compared with the reading emitted by the probe as shown in FIG. 4 for purposes of detecting the top of the cement plug. It will be seen from FIG. 4 that as the top of the cement plug is approached, the probe output increases dramatically beyond the "normal" range of readings and thus there is little chance of error occurring.

Figure 5:
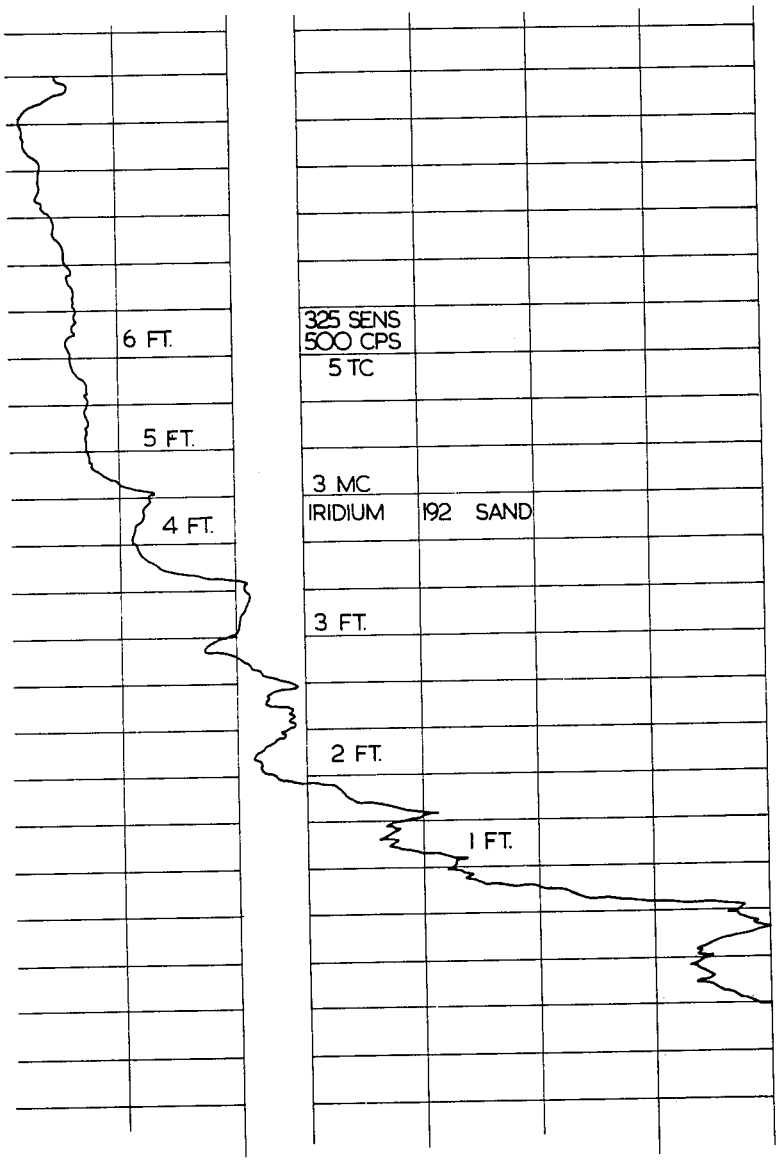
FIG. 5 is a reading of a typical probe output under specified test conditions.

Reading such as shown in FIG. 4 may be readily compared with a standard test reading for the same probe as illustrated in FIG. 5. FIG. 5 plots the output of a gamma-ray logging tool or probe when lowered from a height of 6 feet toward a standard test sample of iridium 192. The probe used was a standard "Comprobe" scintillation counter having a diameter of 1 and 11/16th inches. The sensitivity setting was 325–500 CPS-5TC. By effecting a comparison between the reading given in FIG. 4 with the test reading of FIG. 5, the distance between the probe and the top of the cement plug as the probe nears the latter may be approximately determined.

With further reference to FIG. 4, it will be seen that the output of the probe increases relatively rapidly up to a maximum at point X which represents the probe output when it reaches the top of the radioactive cement layer. As the probe is lowered further into the treated cement it will be seen that the readings do not increase but, rather, tend to become rather irregular, with the readings gradually decreasing as the probe is lowered further down into the wet untreated cement. Thus, the exact position or elevation of the top of the cement plug can be readily determined from the chart reading. The chart reading provides a record which is readily available for inspection by the well owner and/or Government officials.

The total time for lowering the probe and taking the above noted readings in a plug located at about the 3400 foot level consumes approximately 45 minutes. This represents a tremendous saving in time over the eight hour waiting period required in the prior art procedure.

Assuming that the upper level of the first plug has been correctly established, additional plugs may be established in the same fashion as described above. In the event that the top of the first plug is not correctly located i.e. is too low in elevation, the above described procedure is simply repeated over again with the injection of additional cement utilizing the specialized procedure described above to provide a further radioactive layer on the top of the newly added cement. The position is again rechecked by means of lowering the probe thereby obtaining a further chart reading establishing the level of the top of the newly added cement.

Assuming that the first plug is in proper order, the drill pipe is pulled up to the region of the bottom of the next producing zone. This level is known fairly accurately from previously made well log charts. Since, as mentioned above, the well bore is full of fluid material i.e. drilling mud, the drilling mud occupies all of the space above the first plug.

The procedure recited above is repeated i.e. the first small quantity of cement injected carries a tracer material. Then the precalculated volume of cement is injected and finally a small quantity of cement containing the tracer material. The drill stem is then lifted upwardly above the level of the new plug and the probe or detector is then lowered to check the level of the top of the plug. If the level is correct, the drill pipe is lifted upwardly again to the next zone and the procedure is again repeated, thereby providing a succession of correctly positioned cement plugs with the regions between them being filled with the drilling fluid.

I claim:

1. In a method of plugging a potential producing zone or formation of known extent and elevation in a well bore with cement, including the steps of positioning a hollow pipe or stem at a selected location relative to the lower level of the formation and injecting cement through said pipe in an amount estimated to be sufficient to extend at least the full length of said formation to prevent seepage from the formation after the pipe has been withdrawn and the cement has hardened, the improvememt wherein a selected portion of the cement which is injected contains a radioactive tracer therein with said selected portion being injected such as to provide a layer of cement having said tracer therein at the top of the wet cement plug, and wherein said cement which contains the radioactive tracer therein is injected in two parts, one part being injected first, with the untreated cement being injected thereafter and displacing the treated cement upwardly thereby to form a ring of treated cement around said pipe, and the other part of the treated cement being injected last so that it is located within said pipe at about the same level as said one part, the pipe being thereafter withdrawn from the cement thus allowing the two parts of treated cement to flow together to form said layer with one of said parts flowing over the other part if there is a difference in the levels of said two parts of treated cement at the end of the injection step, and, after the pipe has been withdrawn from the wet cement, lowering into the well bore a detecting means sensitive to and emitting an output in response to the presence of the tracer material, and determining the elevation of the top of the wet cement plug by analyzing the output of the detecting means.

2. A method according to claim 1 wherein, in the event the level of the top of the plug is found to be too low, a further quantity of cement is added with a further selected portion of the cement being treated with said tracer such that a layer of cement having the tracer material therein is provided at the top of the newly added cement and the detecting means again lowered into the well bore whereby to determine the elevation of the top of the newly added cement.

3. The method according to claim 1 wherein the output of the detecting means is recorded on a chart which is moved in synchronizm with the detecting means as it is lowered whereby to provide a visual record of the detector output at least at the relevant well bore levels.

4. The method of plugging a plurality of spaced apart potential producing zones or formations of known extents and elevations in a well bore in accordance with the method of claim 1 wherein said cement is first injected so as to plug the lowermost said formation and the level of the top of the first plug detected, and subsequently successively plugging the remaining potential producing formations by repeating the steps of injecting the cement and detecting the upper levels of the cement plugs thus formed, the well bore having drilling fluid or mud therein during the plugging procedure such that the regions between the successive plugs are filled with said drilling fluid.

* * * * *